US006421446B1

(12) United States Patent
Cashion et al.

(10) Patent No.: US 6,421,446 B1
(45) **Date of Patent: *Jul. 16, 2002**

(54) APPARATUS FOR CREATING 3D AUDIO IMAGING OVER HEADPHONES USING BINAURAL SYNTHESIS INCLUDING ELEVATION

(75) Inventors: Terry Cashion; Simon Williams, both of Calgary (CA)

(73) Assignee: QSound Labs, Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/210,036

(22) Filed: Dec. 11, 1998

Related U.S. Application Data

(63) Continuation-in-part of application No. 09/151,998, filed on Sep. 11, 1998, now Pat. No. 6,195,434, which is a continuation of application No. 08/719,631, filed on Sep. 25, 1996, now Pat. No. 5,809,149.

(51) Int. Cl.[7] ..... H04R 5/00
(52) U.S. Cl. ..... 381/17; 381/309
(58) Field of Search ..... 381/1, 17, 18, 381/61, 63

(56) References Cited

U.S. PATENT DOCUMENTS 5,500,900 A * 3/1996 Chen et al. ..... 381/17
6,195,434 B1 * 2/2001 Cashion et al. ..... 381/17

* cited by examiner

*Primary Examiner*—Ping Lee
(74) *Attorney, Agent, or Firm*—Fulbright & Jaworski L.L.P.

(57) ABSTRACT

The apparent location of sound signals as perceived by a person listening to the sound signals over headphones can be positioned or moved in azimuth, elevation and range by a range control block and a location control block. Several range control blocks and location control blocks can be provided depending on the number of input sound signals to be positioned or moved. All of the range and location control is provided by the range control blocks and location control blocks so that the resultant signals require only a fixed number of filters regardless of the number of input audio signals to provide the signal processing. Such signal processing resulting in accurate positioning and moving of the sound source is accomplished using front and back early reflection filters, left and right reverberation filters, front and back azimuth placement filters having a head related transfer function, and up and down elevation placement filters.

20 Claims, 7 Drawing Sheets

FIG. 3
| RANGE INDEX | DIRECT WAVE | RANGED | RANGE DELAY (ms) |
|---|---|---|---|
| 0 | 0.000 | 0.000 | N/A |
| 1-20 | 1.000 | 0.000 | N/A |
| 21 | 0.900 | 0.050 | 50 |
| 22 | 0.850 | 0.100 | 49 |
| 23 | 0.820 | 0.130 | 48 |
| 24 | 0.790 | 0.170 | 47 |
| ⋮ | ⋮ | ⋮ | ⋮ |
| 119 | 0.080 | 0.835 | 1.5 |
| 120 | 0.040 | 0.890 | 0.0 |
FIG. 5
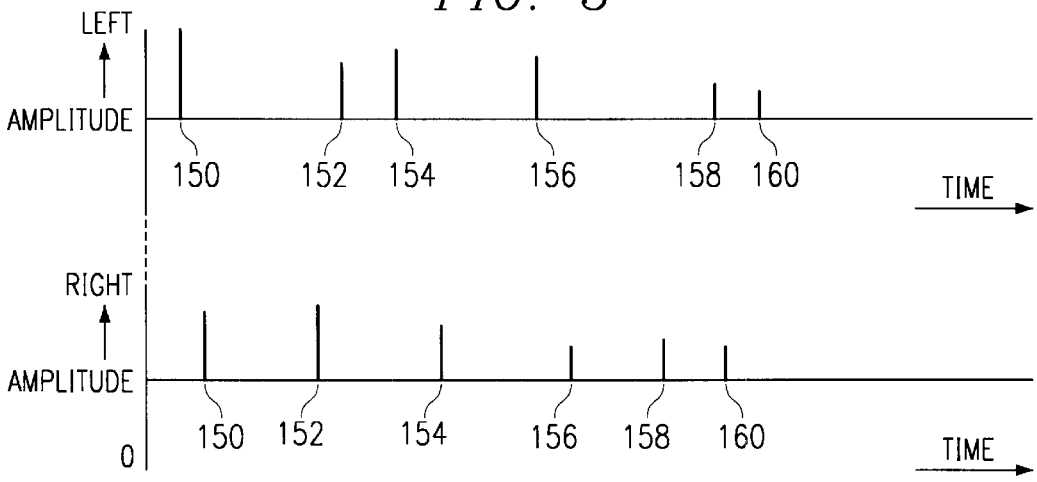
FIG. 6
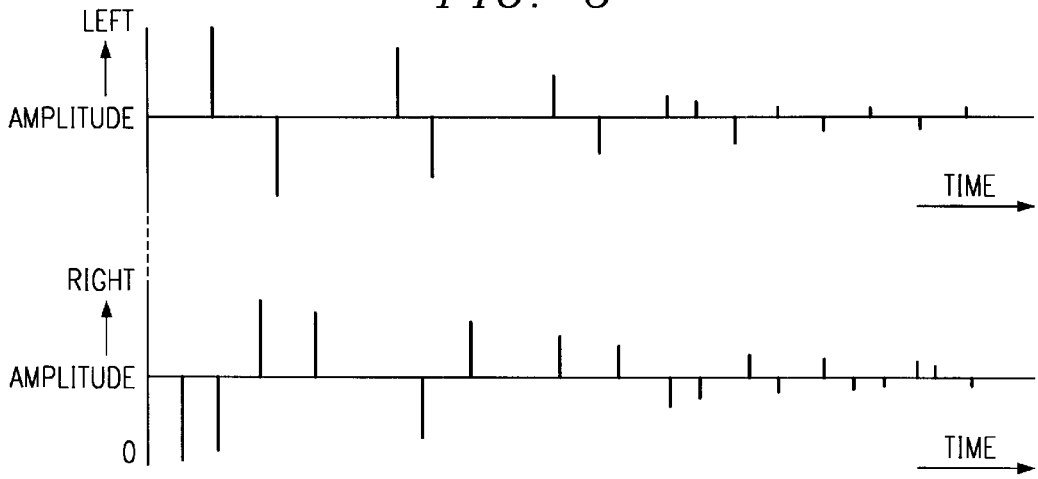

| AZIMUTH INDEX | AMPLITUDE | | DELAY (μs) | |
|---|---|---|---|---|
| | LEFT | RIGHT | LEFT | RIGHT |
| 0 | 1.0 | 0.7071 | 0 | 600 |
| 1 | 1.0 | 0.7300 | 0 | 570 |
| 2 | 1.0 | 0.7530 | 0 | 540 |
| 3 | 1.0 | 0.7760 | 0 | 510 |
| ⋮ | ⋮ | ⋮ | ⋮ | ⋮ |
| 27 | 1.0 | 0.9310 | 0 | 90 |
| 28 | 1.0 | 0.9540 | 0 | 60 |
| 29 | 1.0 | 0.9770 | 0 | 30 |
| 30 | 1.0 | 1.0 | 0 | 0 |
| 31 | 0.9770 | 1.0 | 30 | 0 |
| 32 | 0.9540 | 1.0 | 60 | 0 |
| 33 | 0.9310 | 1.0 | 90 | 0 |
| ⋮ | ⋮ | ⋮ | ⋮ | ⋮ |
| 57 | 0.7760 | 1.0 | 510 | 0 |
| 58 | 0.7530 | 1.0 | 540 | 0 |
| 59 | 0.7300 | 1.0 | 570 | 0 |
| 60 | 0.7071 | 1.0 | 600 | 0 |
| 61 | 0.7300 | 1.0 | 570 | 0 |
| 62 | 0.7530 | 1.0 | 540 | 0 |
| 63 | 0.7760 | 1.0 | 510 | 0 |
| ⋮ | ⋮ | ⋮ | ⋮ | ⋮ |
| 87 | 0.9310 | 1.0 | 90 | 0 |
| 88 | 0.9540 | 1.0 | 60 | 0 |
| 89 | 0.9770 | 1.0 | 30 | 0 |
| 90 | 1.000 | 1.0 | 0 | 0 |
| 91 | 1.0 | 0.9770 | 0 | 30 |
| 92 | 1.0 | 0.9540 | 0 | 60 |
| 93 | 1.0 | 0.9310 | 0 | 90 |
| ⋮ | ⋮ | ⋮ | ⋮ | ⋮ |
| 116 | 1.0 | 0.7760 | 0 | 510 |
| 117 | 1.0 | 0.7530 | 0 | 540 |
| 118 | 1.0 | 0.7300 | 0 | 570 |
| 119 | 1.0 | 0.7071 | 0 | 600 |

*FIG. 4*

*FIG. 7*

| ELEVATION DEGREE | UP MULIPLIER | DOWN MULTIPLIER | FRONT MULTIPLIER | BACK MULTIPLIER |
|---|---|---|---|---|
| 0 | 0.00 | 0.00 | 1.00 | 0.00 |
| 15 | 0.16 | 0.00 | 0.84 | 0.00 |
| 30 | 0.33 | 0.00 | 0.67 | 0.00 |
| 45 | 0.60 | 0.00 | 0.40 | 0.00 |
| 60 | 0.75 | 0.00 | 0.25 | 0.00 |
| 75 | 0.88 | 0.00 | 0.12 | 0.00 |
| 90 | 1.00 | 0.00 | 0.00 | 0.00 |
| 0 | 0.00 | 0.00 | 0.00 | 1.00 |
| 15 | 0.16 | 0.00 | 0.00 | 0.84 |
| 30 | 0.33 | 0.00 | 0.00 | 0.67 |
| 45 | 0.60 | 0.00 | 0.00 | 0.40 |
| 60 | 0.75 | 0.00 | 0.00 | 0.25 |
| 75 | 0.88 | 0.00 | 0.00 | 0.12 |
| 90 | 1.00 | 0.00 | 0.00 | 0.00 |
| 0 | 0.00 | 0.00 | 1.00 | 0.00 |
| −15 | 0.00 | 0.16 | 0.84 | 0.00 |
| −30 | 0.00 | 0.33 | 0.67 | 0.00 |
| −45 | 0.00 | 0.60 | 0.40 | 0.00 |
| −60 | 0.00 | 0.75 | 0.25 | 0.00 |
| −75 | 0.00 | 0.88 | 0.12 | 0.00 |
| −90 | 0.00 | 1.00 | 0.00 | 0.00 |
| 0 | 0.00 | 0.00 | 0.00 | 1.00 |
| −15 | 0.00 | 0.16 | 0.00 | 0.84 |
| −30 | 0.00 | 0.33 | 0.00 | 0.67 |
| −45 | 0.00 | 0.60 | 0.00 | 0.40 |
| −60 | 0.00 | 0.75 | 0.00 | 0.25 |
| −75 | 0.00 | 0.88 | 0.00 | 0.12 |
| −90 | 0.00 | 1.00 | 0.00 | 0.00 |

APPARATUS FOR CREATING 3D AUDIO IMAGING OVER HEADPHONES USING BINAURAL SYNTHESIS INCLUDING ELEVATION

RELATED APPLICATIONS

The present application is a continuation in part of and commonly assigned U.S. application Ser. No. 09/151,998, entitled APPARATUS FOR CREATING 3D AUDIO IMAGING OVER HEADPHONES USING BINAURAL SYNTHESIS filed Sep. 11, 1998, now issued as U.S. Pat. No. 6,195,434, which is incorporated herein by reference, which is a continuation of U.S. application Ser. No. 08/719,631, filed Sep. 25, 1996, now U.S. Pat. No. 5,809,149, entitled APPARATUS FOR CREATING 3D AUDIO IMAGING OVER HEADPHONES USING BINAURAL SYNTHESIS issued Sep. 15, 1998, which is incorporated herein by reference.

TECHNICAL FIELD

This invention relates generally to a sound image processing system for positioning audio signals reproduced over headphones and, more particularly, for causing the apparent sound source location to move in azimuth, range and elevation relative to the listener with smooth transitions during the sound movement operation.

BACKGROUND

Due to the proliferation of sound sources now being reproduced over headphones, the need has arisen to provide a system whereby a more natural sound can be produced and, moreover, where it is possible to cause the apparent sound source location to move as perceived by the headphone wearer. For example, video games both based on the home personal computer and based on the arcade-type games generally involve video movement with an accompanying sound program in which the apparent sound source also moves. Nevertheless, as presently configured, most systems provide only a minimal amount of sound movement that can be perceived by the headphone wearer and, typically, the headphone wearer is left with the uncomfortable result that the sound source appears to be residing somewhere inside the wearer's head.

A system for providing sound placement during playback over headphones is described in U.S. Pat. No. 5,371,799 issued Dec. 6, 1994 and assigned to the assignee of this application, which patent is incorporated herein by reference. In that patent, a system is described in which front and back sound location filters are employed and an electrical system is provided that permits panning from left to right through 180° using the front filter and then from right to left through 180° using the rear filter. Scalars are provided at the filter inputs and/or outputs that adjust the range and location of the apparent sound source. This patented system requires a large number of circuit components and filtering power in order to provide realistic sound image placement and in order to permit movement of the apparent sound source location using the front and back filters, a pair of which are required for the left and right ears.

At present there exists a need for a sound positioning system for use with headphones that can create three-dimensional audio imaging without requiring complex and expensive filtering systems, and which can permit panning of the apparent sound location for one or more channels or voices.

SUMMARY OF THE INVENTION

These and other objects, features and technical advantages are achieved by a system and method which provides an apparatus for creating three dimensional audio imaging during playback over headphones using a binaural synthesis approach.

It is another object of the present invention to provide apparatus for processing audio signals for playback over headphones in which an apparent sound location can be smoothly panned over a number of locations without requiring an unduly complex circuit.

It is another object of the present invention to provide an apparatus for reproducing audio signals over headphones in which a standardized set of filters can be provided for use with a number of channels or voices, so that only one set of filters is required for the system.

It is another object of the present invention to provide an apparatus for processing audio signals for playback over headphones, for causing the apparent sound source location to move in elevation relative to the listener with smooth transitions during the sound movement operation.

In accordance with an aspect of the present invention, the apparent sound location of a sound signal, as perceived by a person listening to the sound signals over headphones, can be accurately positioned or moved using front and back azimuth placement filters, elevation placement filters, early reflection filters, and a reverberation filter. The inputs to the filters are controlled using variable attenuators or scalars that are associated with each input signal and not with the filters themselves.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 3 is a chart showing values typically employed in a range look-up table used in the embodiments of FIGS. 2A, 2B and 2C;

FIG. 4 is an amplitude and delay table showing possible values for use in achieving the amplitude and ranging in the embodiments of FIGS. 2A, 2B and 2C;

FIG. 5 is a representation of six early reflections in an early reflection filter as used in the embodiments of FIGS. 2A, 2B and 2C;

FIG. 6 is a representation of the reverberation filters used in the embodiments of FIGS. 2A, 2B and 2C; and FIG. 7 is a chart showing values used to adjust the amount of signal fed to front and back placement filters and the up and down elevation placement filters.

DETAILED DESCRIPTION

The present invention relates to a technique for controlling the apparent sound source location of sound signals as perceived by a person when listening to those sound signals over headphones. This apparent sound source location can be represented as existing anywhere in a sphere with the listener at the center of the sphere.

Figure 1:
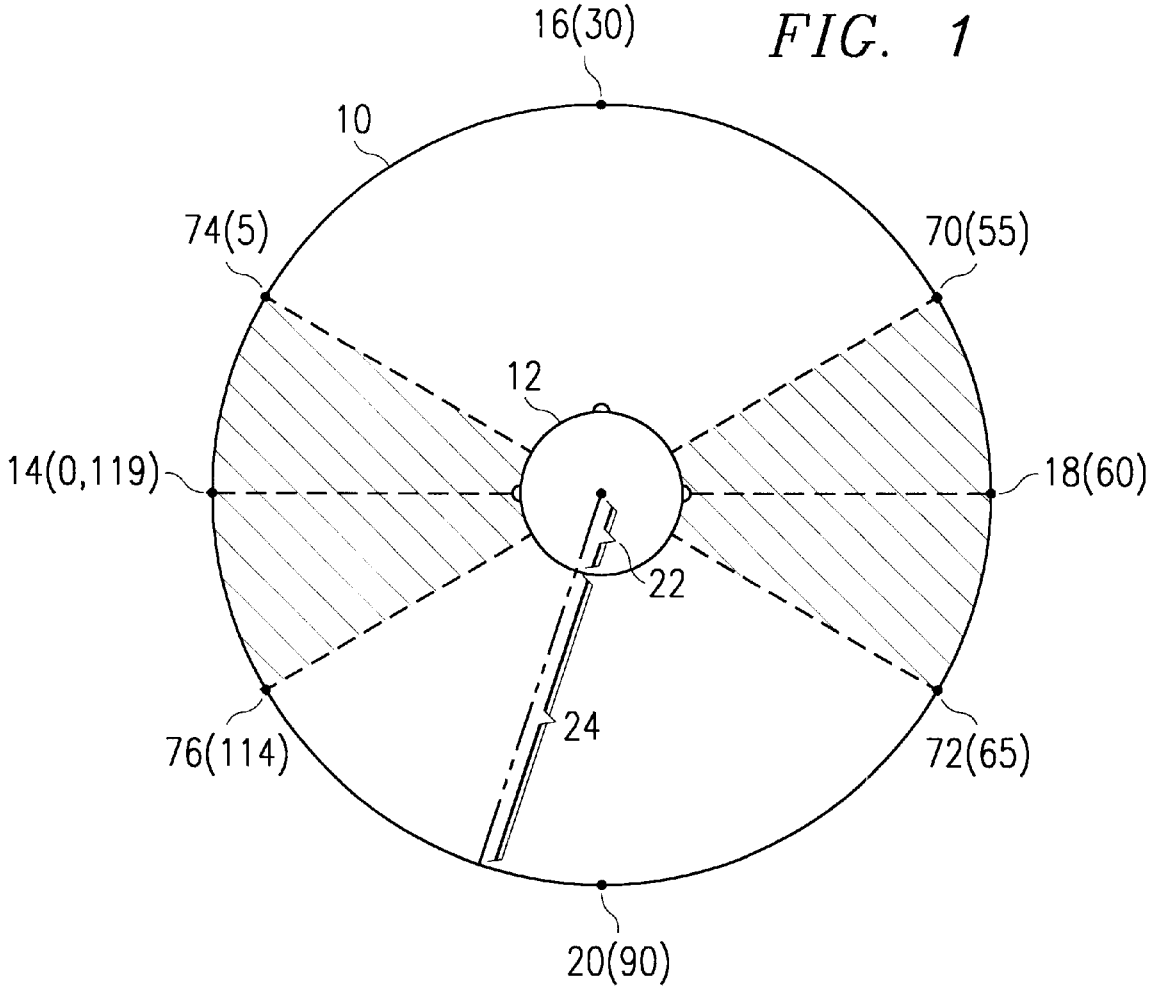
FIG. 1 is a representation of an auditory space with an azimuth and range shown relative to a headphone listener.

FIG. 1 shows a latitudinal circle 10 of the sphere with the listener 12 shown generally at the center of the circle 10. Circle 10 can be arbitrarily divided into 120 segments for assigning azimuth control parameters. The location of a sound source can then be smoothly panned from one segment to the next, so that listener 12 can perceive continuous movement of the sound source location. The segments are referenced or identified arbitrarily by various positions and, according to the present embodiment, position 0 is shown at 14 in alignment with the left ear of listener 12 and position 30 is shown at 16 directly in front of listener 12. Similarly, position 60 is at 18 aligned with the right ear of listener 12 and position 90 is at the rear of the listener, as shown at point 20. Because the azimuth position parameters wrap around at value 119, positions 0 and 119 are equivalent at point 14.

For sound locations that are above or below the horizontal plane of listener 12 an elevation parameter is used. This parameter allows control over a location above the horizontal plane or a location below the horizontal plane shown in FIG. 1. In this way any location in three dimensional space around the listener can be described uniquely.

The range or apparent distance of the sound source is controlled in the present invention by a range parameter. The distance scale is also divided into 120 steps or segments with a value 1 corresponding to a position at the center of the head of listener 12 and value 20 corresponding to a position at the perimeter of the head of listener 12, which is assumed to be circular in the interest of simplifying the analysis. The range positions from 1–20 are represented at 22 and the remaining range positions 21 through 120 correspond to positions outside of the head as represented at 24 in FIG. 1. The maximum range of 120 is considered to be the limit of auditory space for a given implementation and, of course, can be adjusted based upon the particular implementation.

Figure 2A:
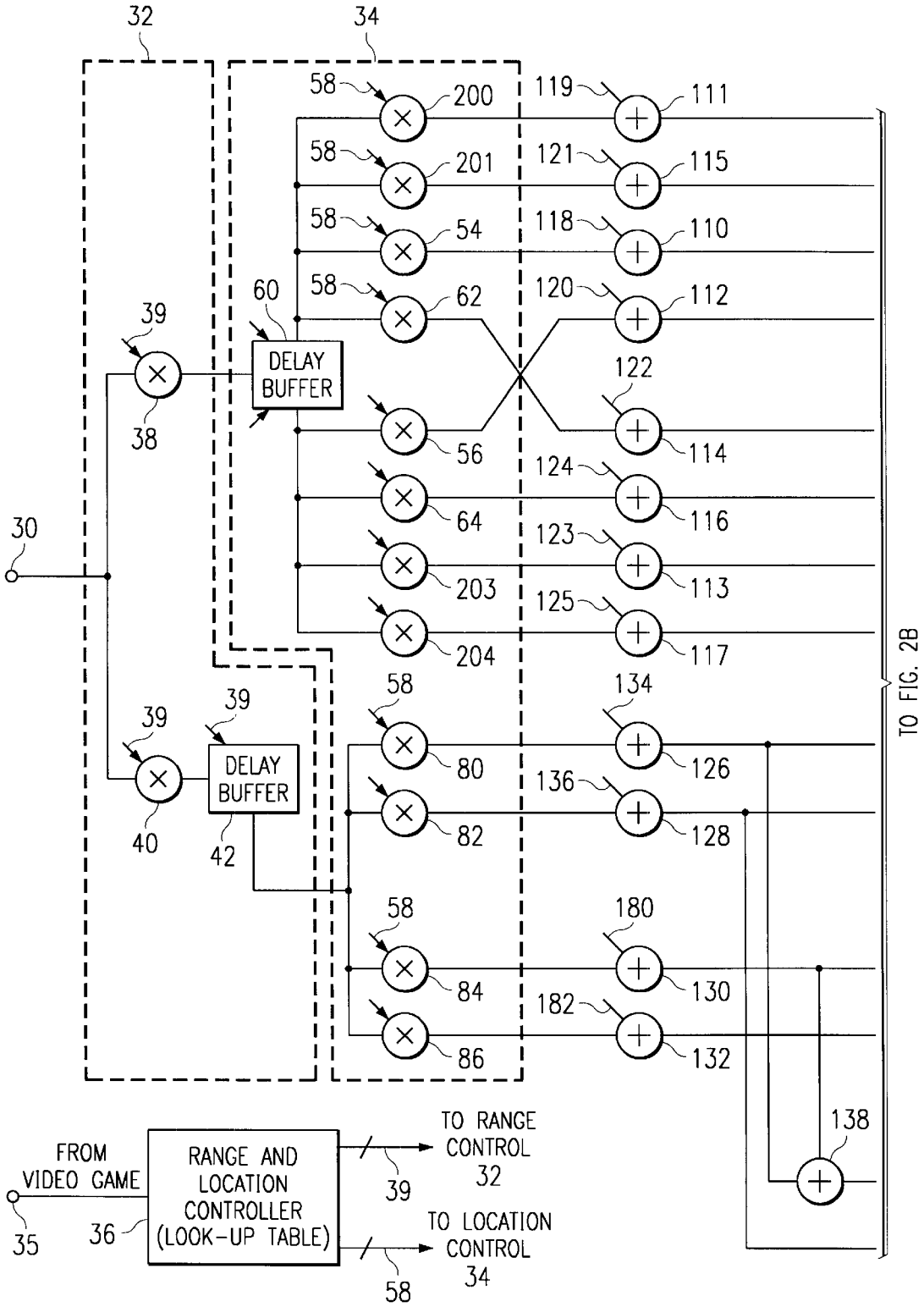
FIGS. 2A, 2B and 2C are a schematic in block diagram form of a headphone processing system using binaural synthesis to produce localization of sound signals according to an embodiment of the present invention.
Figure 2B:
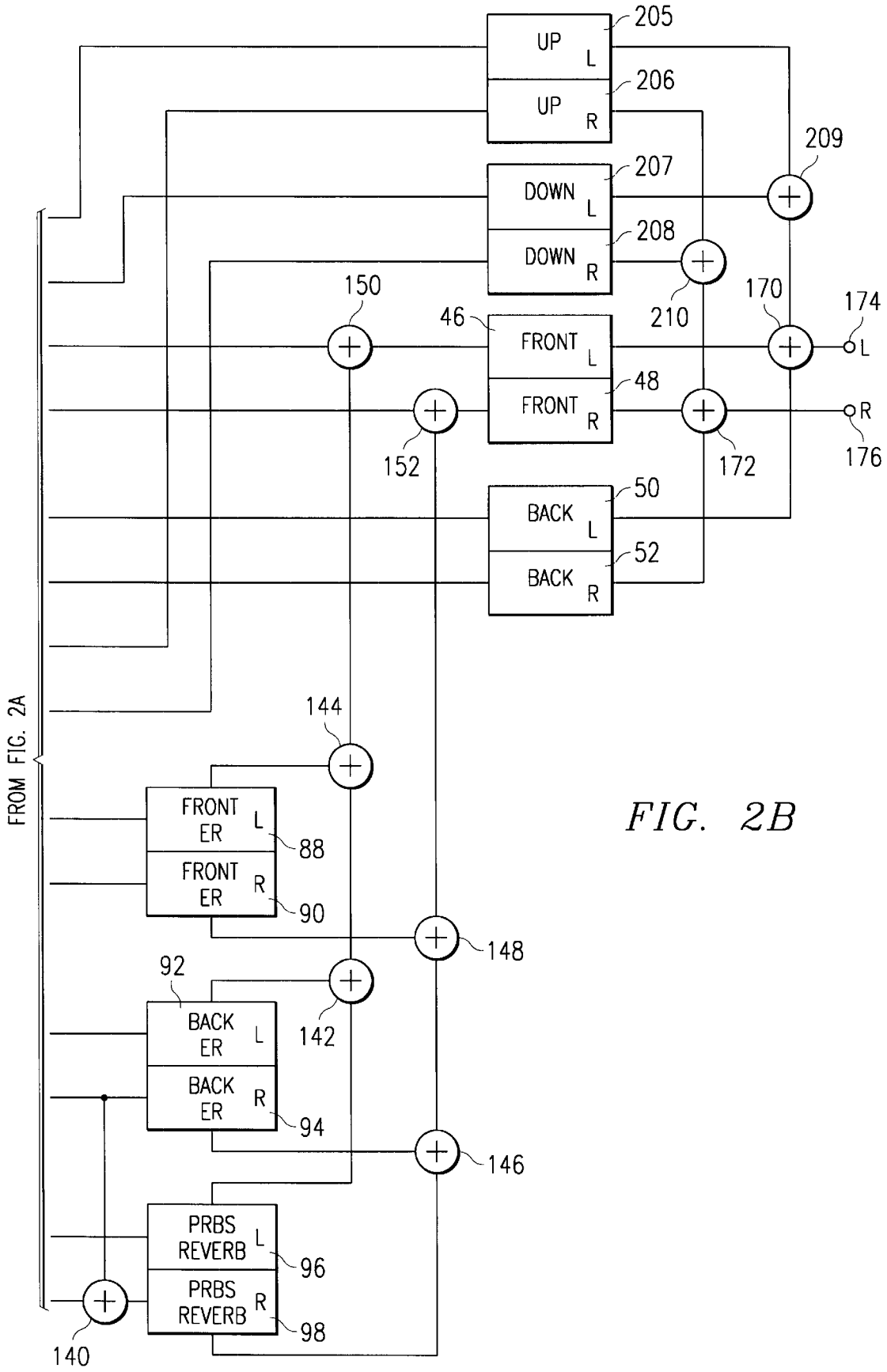
Figure 2C:
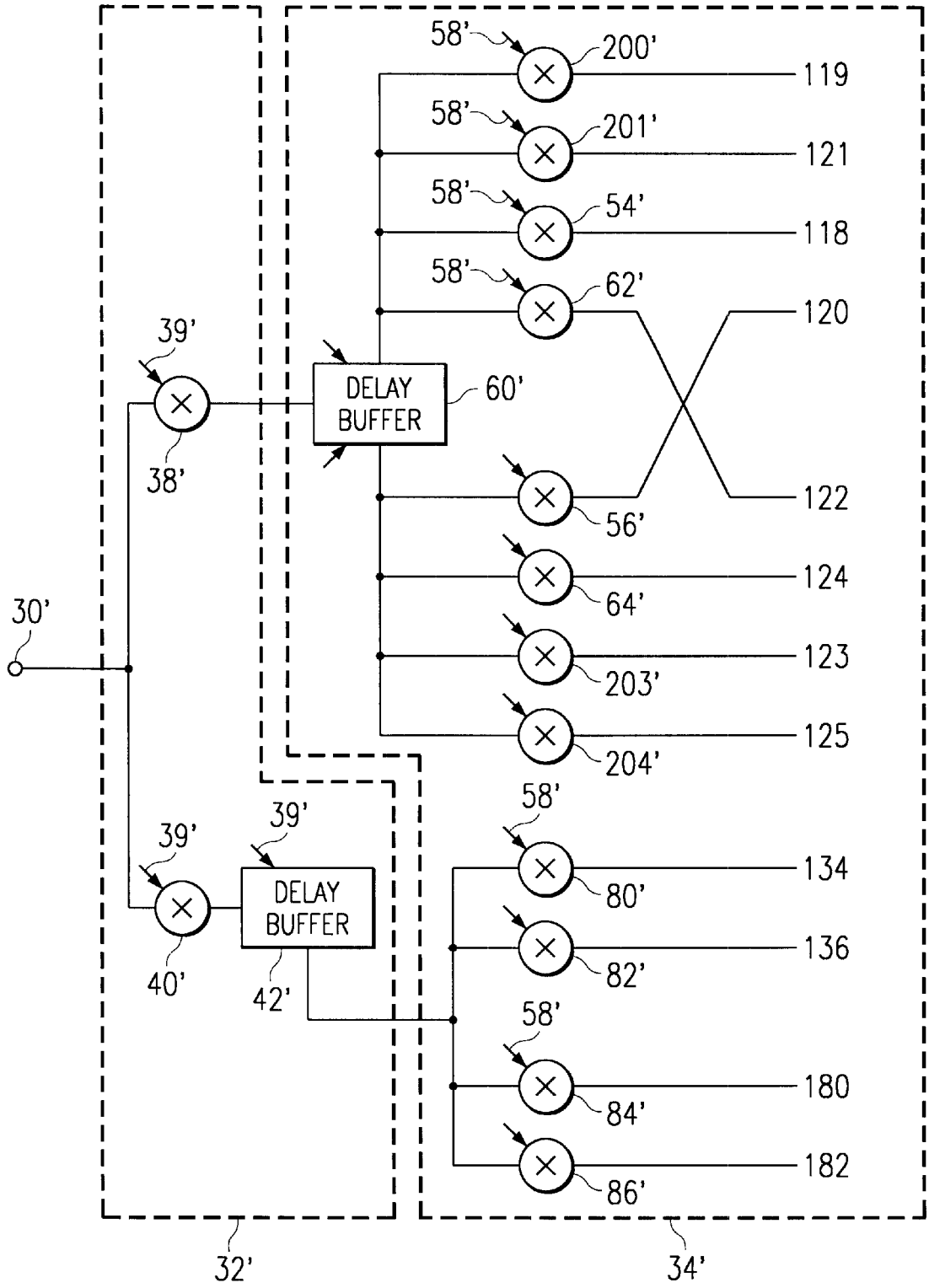

FIGS. 2A, 2B and 2C are embodiments of the present invention using a binaural synthesis process to produce sound localization anywhere in a sphere centered at the head of a listener, such as the headphone listener 12 of FIG. 1. As is known, the sound emanating from a source in a room can be considered to be made up of three components. The first component is the direct wave representing the sound waves that are transmitted directly from the source to the listener's ears without reflecting off any surface. The second component is made up of the first few sound waves that arrive at the listener after reflecting off only one or two surfaces in the room. These so-called early reflections arrive approximately 10 milliseconds to 150 milliseconds after the arrival of the direct wave. The third component is made up of the remaining reflected sound waves that have followed a circuitous path after having been reflected off various room surfaces numerous times prior to arriving at the ear of the listener. This third component is generally referred to as the reverberant part of a room response. It has been found that a simulation or model of this reverberant component can be achieved by using a pseudo-random binary sequence (PRBS) with exponential attenuation or decay.

Referring to FIG. 2A, an input audio signal is fed in at terminal 30 and is first passed through a range control block shown within broken lines 32 and then an azimuth and elevation control block or location control block shown within broken lines 34.

The range control block 32 employs a current value of the range parameter as provided by the video game program, for example, as an index input at 35 to address a look-up table employed in a range and location controller 36. As will be explained, this range and location controller 36 can take different forms depending upon the manner in which the present invention is employed. The look-up table shown in FIG. 3 consists of two scale factor values and one time delay value for each index or address in the table. These indexes correspond to the in-the-head range positions 1 through 20 shown at 22 in FIG. 1, and the out-of-the-head range positions 21 through 120, shown at 24 in FIG. 1. The input audio signal at terminal 30 is fed to a first scaler 38 that is used to scale the amount of signal that is sent through the location processing portion of the embodiment of FIGS. 2A and 2B. Scaler 38 is set according to the range parameter using the value in the "Direct Wave" column of the table shown in FIG. 3. In particular, the range index of the table in FIG. 3 is used to look up the direct wave fed to scaler 38 on lines 39.

In that regard, FIG. 3 shows the look-up table of the range and location controller 36 having representative scale factor values and time delays. The input audio signal is also fed to a second scaler 40 that forms a part of the range control block 32. This second scaler 40 is used to scale the amount of signal that is sent through the ranging portion of the embodiment of FIGS. 2A and 2B. Scaler 40 receives the ranged scale factor value on lines 39 from the look-up table shown in FIG. 3, as contained within the range and location controller 36. In other words, scaler 38 receives a direct wave value from the look-up table and scaler 40 receives a ranged value from the look-up table represented by FIG. 3 based on the range index fed in at input 35 of the range and location controller 36.

The third element identified by the range index and obtained from the look-up table is a pointer into a delay buffer 42 that is part of the range control block 32. This pointer is produced by the range and location controller 36, as read out from the look-up table and fed to delay buffer 42 on lines 39. This delay buffer 42 delays the signal sent to the range processing block 34 from anywhere between 0 to 50 milliseconds. This buffer 42 then adjusts the length of time between the direct wave and the first early reflection wave. As will be seen, as the range index increases the actual ranged time delay decreases. The minimum range index value outside the head of 21 is associated with the maximum time delay of 50 milliseconds, whereas the maximum range index value of 120 has the minimum delay of 0.0 milliseconds.

The location control block 34 uses the current value of the location parameters as produced by the range and location controller 36 using a look-up table that contains the various azimuth values as represented in FIG. 4, for example, to establish the amount of signal sent to each side of the azimuth placement filters and to elevation placement filters, which will be described hereinbelow.

Each of the scaler pairs 54/56, 62/64, 200/203 and 201/204 are set using the table in FIG. 4. In addition, the amount of signal sent to placement filters 46, 48, 50, 52, 205, 206, 207, 208 is further scaled according to the desired location of the sound image. These further adjustments to all the scalars are tabulated in FIG. 7. Once the scaler pairs 54/56, 62/64, 200/203 and 201/204 have been set using the table shown in FIG. 4, the desired location of the sound image is used to adjust these scalar values. For example, if the desired sound image location is in the horizontal plane at 45 degrees to the right of the listener, the scalers feeding placement filters 205, 206, 207, 208, 50 and 52 are all set to zero. Only the signals going to placement filters 46 and 48 are active. Alternatively, if the desired sound image location is elevated 60 degrees above and directly behind the listener, the scalers feeding placement filters 46, 48, 207 and 208 are set to zero. In this case, scalers 200, 203, 62 and 64 for placement filters 205, 206, 50 and 52 are set using the data in the table of FIG. 4.

The table in FIG. 7 is used to control the amount of signal passed to the UP and DOWN elevation filters 205, 206 and 207, 208 when the desired location of the sound source is above or below the horizontal plane of the listener. Note that the first set of elevation degrees from 0 to 90 at the top of the chart of FIG. 7 are for a sound location or position up and to the front of a listener, the second set of elevation degrees are for a sound location or position up and to the back of a listener, the third set of elevation degrees are for a sound location or position down and to the front of a listener, and the fourth set of elevation degrees are for a sound location or position down and to the back of a listener. The elevation degree, received from range and location controller 36, is used to look-up the multipliers used to weight the amount of signal being sent to the UP and DOWN elevation placement filters and the FRONT and BACK azimuth placement filters. This additional adjustment of the scalars provides a method for adding an elevation effect to that produced by the azimuth and ranging components of the invention. For example, as shown in the table of FIG. 7, when the location of the sound source is at an elevation degree of 0 in front of the listener, the UP, DOWN, and BACK filter multipliers are set to a value of zero and the FRONT filter multiplier is set to a value of 1. Similarly, when the location of the sound source is at an elevation degree of 90 directly above (zenith) the listener, the UP multiplier is set to 1 and the DOWN, FRONT and BACK multipliers are set to zero. Furthermore, when the desired location of the sound source is at an elevation degree of −60 and directly behind the listener, the UP and FRONT multipliers are set to zero, and the DOWN and BACK multipliers are set to 0.75 and 0.25 respectively. Furthermore, the values of the multipliers for any intermediate elevation degree can be calculated by interpolating between the values shown.

It should be appreciated by those skilled in the art that the present invention achieves azimuth and elevation adjustment independent of each other. The position of a sound can be made to change in azimuth (left-right and front-back) and/or elevation (up-down) by using tables of scalar values that are smoothly varying. Suitable combinations of these will allow any position to be selected with a smooth trajectory when the sound source object is moving.

The location control block 34 uses the current value of the location parameters (azimuth and elevation) to establish the amount of signal sent to each side of the location placement filters, which in this embodiment include a left front filter 46, a right front filter 48, a left back filter 50, a right back filter 52, a left up filter 205, a right up filter 206, a left down filter 207, and a right down filter 208. Once again, the current azimuth parameter value is used as an index or address in a look-up table, shown in FIG. 4, that consists of pairs of left and right amplitude and delay entries. The first two columns in FIG. 4 relating to amplitude are used to set the scalers 54 and 56 that control how much signal is fed to the left and right sides of the front azimuth placement filters 46 and 48. These location control values are fed out of the range and location controller 36 on lines 58 and these values are represented by the arrows to scalers 54 and 56. The values are modified by the elevational scale table as shown in FIG. 7, depending on the elevational location of the sound source. As the source moves away from the horizontal plane of FIG. 1, the values are scaled down, and more of the energy is sent to the up/down filters. The approach just described for FRONT azimuth placement filters 46, 48 is also used to set BACK azimuth placement filters 50, 52, UP elevation placement filters 205, 206, and DOWN elevation placement filters 207, 208.

The second parameters contained within the look-up table of FIG. 4 forming a part of the range and location controller 36 provide a time delay at the left and right sides of the front azimuth placement filters 46, 48 (as well as a delay at the left and right sides of placement filters 50, 52, 205, 206, 207 and 208), which delay is proportional to the current azimuth position as represented by the azimuth index 0–119 as shown in FIG. 4. This delay information shown in FIG. 4 is used to set the values of pointers in a delay buffer 60. As can be seen from the values in the table of FIG. 4, the signal sent to the right front azimuth filter 48 is delayed a relative to the signal fed to the left front azimuth filter 46 for azimuth positions 0–29. For azimuth positions from 31–59 the signal sent to the left front azimuth filter 46 is delayed relative to the signal passing through the right side or the right front azimuth filter 48. If the azimuth value is greater than 60, keeping in mind that 60 represents the right side of the listener as shown FIG. 1, the sound signals are passed through the back azimuth placement filters represented by the left back azimuth filter 50 and the right back azimuth filter 52. This is accomplished by setting the scalers 54 and 56 to zero and applying the scale factor obtained from the look-up table, according to the current location parameter value, to scalers 62 and 64, which control the amount of signal sent to the left back azimuth filter 50 and the right back azimuth filter 52. The value for the pointer into delay buffer 60 is obtained from the appropriate entry in the look-up table shown in FIG. 4 as described above and serves to delay one of the signals sent to the left back azimuth filter 50 or the right back azimuth filter 52. For azimuth positions 61–89, the signal passed to the left side of the back azimuth placement filter 50 is delayed relative to the right side. For azimuth positions from 91–119, the signal passed to the right back azimuth placement filter 52 is delayed relative to the signal fed to the left back azimuth filter 50.

According to the present invention, the use of the amplitude delay look-up table shown in FIG. 4, for example, in connection with the location placement filters 46, 48, 50 and 52 is based on an approximation of the changes in the shape of the head related transfer function (HRTF) as a sound source moves from the position directly in front of the listener, such as point 16 in FIG. 1, to a position to the left or right of the listener, such as points 14 or 18 in FIG. 1. The sound waves from a sound source propagate to both ears of a listener and for sound directly in front of the listener, such as point 16, the signals reach the listener's ears at substantially the same time. As the sound source moves to one side, however, the sound waves reach the ear on that side of the head relatively unimpeded, whereas the sound waves reaching the ear on the other side of the head must actually pass around the head, thereby giving rise to what is known as the head shadow. This causes the sound waves reaching the shadowed ear to be delayed relative to the sound waves reaching the other ear that is on the same side of the head as the sound source. Moreover, the overall amplitude of the sound waves reaching the shadowed ear is reduced relative to the amplitude or sound wave energy reaching the ear on the same side as the sound source. This accounts for the change in amplitude in the left and right ears shown in FIG. 4 and the time delays for off access positions. These amplitude delay values are also applied to signals input to the elevation placement filters 205, 206, 207 and 208 to insure proper blending or mixing of the signals at summers 172 and 174, in order to avoid processing artifacts.

In addition to such large magnitude changes there are other more subtle effects that affect the frequency content of the sound wave reaching the ears. These changes are caused partially by the shape of the human head but for the most part such changes arise from the fact that the sound waves must pass by the external or physical ears of the listener. For each particular azimuth angle of the sound source there are corresponding changes in the amplitude of specific frequencies at each of the listener's ears. The presence of these variations in the frequency content of the input signals to each ear is used by the brain in conjunction with other attributes of the input signals to the ear to determine the precise location of the sound source.

The changes caused by the head and external ears of the listener are also very important in evaluating the attribute of elevation for a sound source. The signals are filtered differently depending on the angle of elevation. For example, for a sound source that is below the head of the listener, the torso and shoulders play a role as well. For the purpose of this invention the goal of simplifying the processing required to achieve reasonable sound image placements in three dimensional space demands these effects be approximated. Therefore, the elevation effect is achieved by separating the effects due to the azimuth portion of the sound source location from those attributable to the elevation portion of the sound source location.

The changes in the ear input signals for a sound source that is elevated can be modeled as changes in the energy of specific frequency bands of the audio spectrum. Taking the first order approximation, sounds emanating from a sound source above a listener will have certain frequency bands attenuated or amplified by the effects of the head and ears. Therefore a single UP placement filter can be constructed as a Finite Impulse Response filter (FIR) or an Infinite Impulse Response filter (IIR). Sounds from below the head of a listener will have other frequency bands attenuated or amplified. Once again, a single DOWN filter can be built as an FIR or IIR. By adjusting the amount of signal that is processed through the UP (or DOWN) placement filters the degree of elevation can be controlled. Note that in the extreme case elevation collapses to a single point directly above (zenith) or directly below (nadir) the listener. The UP and DOWN elevation placement filters used in this implementation are representative of these two extreme cases.

The approach of separating the azimuth component from the elevation component has limitations when choosing coordinate systems for describing the desired spatial location of sound images. Care must be taken to ensure that non-physical coordinate combinations are ignored. For example, using azimuth, elevation and range to describe the desired location of a sound image it is possible to select a location at 90 degrees to the left of the listener and 90 degrees of elevation above while the sound image is close to the head of the listener. This is physically impossible since an object at 90 degrees elevation above the listener cannot also be to one side of the listener. Therefore, care is taken in implementing the range and location controller 36 to ensure such problematic coordinate combinations are ignored. One method for avoiding incorrect coordinate combinations is to assign a precedence or priority to the possible coordinates. For example, if elevation is assigned a higher priority than azimuth, and a conflict is detected while checking the coordinates input to range and location controller 36, the elevation parameter is honored and the azimuth parameter is adjusted to the nearest acceptable value. An alternative method for avoiding incorrect coordinate combinations is to convert input coordinates of azimuth, elevation and range to Cartesian coordinates. A priority scheme can be used to ensure that the derived coordinate values are physically acceptable.

Therefore, it will be appreciated by those skilled in the art that in order to implement a binaural synthesis process for listening over headphones, it will be necessary to utilize a large number of head related transfer functions to achieve the effect of assigning an input sound signal to any given location within a three-dimensional space. Typically, head related transfer functions are implemented using a FIR of sufficient length to capture the essential components needed to achieve realistic sound signal positioning. Needless to say, the cost of signal processing using such an approach can be so excessive as to generally prohibit a mass-market commercial implementation of such a system. According to the present invention, in order to reduce the processing requirements of such a large number of head related transfer functions, the FIR's are shortened in length by reducing the number of taps along the length of the filter. Another simplification according to the present invention is the utilization of a smaller number of head related transfer function filters by using filters that correspond to specific locations and then interpolating between these filters for intermediate positions. Although these proposed methods do, in fact, reduce the cost, there still remains a significant amount of signal processing that must be performed. The present invention provides an approach not heretofore suggested in order to obtain the necessary cues for azimuth position in binaural synthesis.

It is noted that the human brain determines azimuth as being heavily dependent on the time delay and amplitude difference between the two ears for the sound source somewhere to one side of the listener. Using this observation, an approximation of the head related transfer functions was implemented that relies on using a simple time delay and amplitude attenuation to control the perceived azimuth of a source location in front of a listener. The present invention incorporates a generalized head related transfer function that corresponds to a sound source location in front of the listener and this generalized head related transfer function provides the main features relating to the shadowing effect of the head. Then, to synthesize the azimuth and elevation location for a sound source, the input signal is split into two parts. One of the signals obtained by the splitting is delayed and attenuated according to the value stored in the amplitude and delay table represented in FIG. 4, and this is passed to one side of location placement filters as represented by the filters 46, 48, 50, 52, 205, 206, 207, and 208 in FIG. 2B. The other signal obtained by the split is passed unchanged to the other side of the same location placement filter that the attenuated and delayed signal was passed to. In this way a sound image is caused to be positioned at the desired azimuth. The location placement filters then alter the frequency content of both signals to simulate the effects of the sound passing by the head. To place the sound image at the desired elevation, the signals passing through the location placement filters are further scaled using the values in the table shown in FIG. 7. This results in a significant reduction in processing requirements yet still provides an effective perception of the azimuth and elevation attributes of the localized sound source.

Referring back to FIG. 1, an improvement with respect to the crossover point between the front and back azimuth positions would be to introduce a cross fading region at either side of azimuth positions 0 and 60, that is, points 14 and 18 respectively in FIG. 1. For example, over a range of eleven azimuth positions, the signals to be processed by the front and back azimuth filters 46, 48 and 50, 52 are cross faded to provide a smooth transition between the front and back azimuth locations. For example, in FIG. 1, starting at azimuth position 55 at point 70, the signal is divided so that most of the signal goes to the front azimuth filter 46, 48 and a small amount of the signal goes to the back azimuth filter 50, 52. At azimuth position 60 shown at point 18, equal amounts of the signal are sent to the front filters 46, 48 and back filters 50, 52. At azimuth position 65 shown at point 72 most of the signal goes to the back filters 50, 52 and a small amount of the signal goes to the front azimuth placement filters 46, 48. This improves the transition from a front azimuth position to a back azimuth position. The use of five steps on either side of the direct position 60 is an arbitrary number and can be more or less depending upon the accuracy of sound image placement and granularity that can be tolerated. Of course, this approach also applies to the crossover region at the left side at azimuth points 0 and 119 shown at point 14. In that regard, the cross fade could start at azimuth position 5 shown at 74 and end at azimuth position 114 shown at 76.

The crossfade region just described is also represented in the table of values found in FIG. 7 used in elevation processing. The proportion of signal sent to the UP (or DOWN) elevation placement filter is chosen such that the perceived location of the sound image changes smoothly over the range of the elevation parameters (from 0 to +/−90 degrees). When a sound location, at any arbitrary azimuth, is moved up (or down) from the horizontal plane of the listener the amount of signal sent to the elevation placement filter is increased smoothly as a function of the current elevation parameter. The data in the table of FIG. 7 follows a nonlinear curve. This nonlinear curve has been selected to account for a perceptual limitation of the human hearing system. Sound sources that are at large distances (large range indices) are not perceived elevated to the same degree as the actual measured elevation would imply. Testing has shown that mapping the elevation parameter in a linear fashion leads to a gap in the virtual sound space. The table in FIG. 7 reflects the values necessary to fill the gap in the virtual sound space. Therefore at large distances the elevation processing is accented relative to the actual value of the elevation parameter. It will be appreciated by those skilled in the art that this particular approach is only one of a number of possible methods of solving this problem.

The range and location controller 36 of FIG. 2A is also employed to determine the value of the scalars employed in the early reflection and reverberation filters. More specifically, the range and location controller 36 provides values or coefficients on lines 58 to the location control section 34. Specifically, the coefficients are fed to the scalers 80, 82, 84, and 86 to set the amount of signal forwarded to the early reflection filters that comprise the left front early reflection filter 88, the right front early reflection filter 90, the left back early reflection filter 92, and the right back early reflection filter 94. More particularly, the signal obtained from delay buffer 42 is divided and sent to the early reflection filters 88, 90, 92, 94 and is also sent to the reverberation filters that comprise the pseudo-random binary sequence filters with exponential decay, in which the left filter is shown at 96 and the right filter is shown at 98 in FIG. 2B.

For azimuth positions between 0 and 59, as represented in FIG. 1, the scalers 80 and 82 are set according to the current location parameter value as derived from the amplitude and delay chart shown in FIG. 4. That is, one of the scalers 80 and 82 is set to 1.0 while the other scaler is set to a value between 0.7071 and 1.0, depending on the actual azimuth value. If the current azimuth setting is from 0 to 29, the scaler 80 is set to 1.0 and the scaler 82 is set to a value between 0.7071 and 1.0. If the azimuth setting is between 31 and 59 as represented in FIG. 1, then scaler 82 is set to 1.0 and the scaler 80 is set to a value between 0.7071 and 1.0. Similarly, the scalers 84 and 86 are both set to 0 if the azimuth setting is less than 61, that is, if there is no location of the sound source corresponding to the back position of FIG. 1. For azimuth settings greater than 60 a similar approach as described above is used to set scalers 84 and 86 to the appropriate nonzero values, while the scalers 80 and 82 are set to 0. For example, if the current azimuth setting is from 61 to 89, the scaler 86 is set to 1.0 and the scaler 84 is set to a value between 0.7071 and 1.0. If the azimuth setting is between 91 and 119, the scaler 84 is set to 1.0 and the scaler 86 is set to a value between 0.7071 and 1.0.

By providing values for scalers as described above, it is insured that an input sound signal intended for the front half is processed through the left and right front early reflection filters 88 and 90 and an input signal intended for the back is processed through the left and right back early reflection filters 92 and 94.

The above-described system for determining the values of scalers 80, 82, 84, 86 using the amplitude for the left and right sides as shown in FIG. 4 permits a method for setting the amount of sound passed to each side of the front and back early reflection filters 88, 90, 92, and 94 that is independent of the system used to send the signal to the azimuth placement filters 46, 48, 50, 52, 205, 206, 207, and 208. More specifically, a different amplitude table can be used to scale the signal sent to each side of the early reflection filters 88, 90, 92, and 94 than is used in the case of the azimuth placement filters. Moreover, this system can be further simplified if desired in the interests of economy such that the values used for the scalers 54, 62, 56, and 64 can also be used as the values for the scalers 80, 84, 82, and 86. More particularly, the value for scaler 80 is set to the value for the scaler 54, the value for scaler 82 is set to the value for scaler 56, the value for scaler 84 is set to the value for scaler 62, and the value for scaler 86 is set to the value for scaler 64.

The present invention contemplates that more than one input signal, in addition to the one signal shown at 30, might be available to be processed by the present invention, that is, there may be additional parallel channels having audio signal input terminals similar to terminal 30 such as terminal 30'. These parallel channels might be different voices or sounds or instruments or any other kind of different audio input signals. FIG. 2C shows a second input signal which is fed in at terminal 30' and first passes through a range control block 32' shown within broken lines, and then a location control block 34' shown within broken lines. The input audio signal at terminal 30' is fed to a scaler 38' that is used to scale the amount of signal that is sent through the azimuth and elevation processing portion of the embodiment of FIG. 2C. Like the scaler 38 of FIG. 2A, scaler 38' operates in response to a direct wave scale factor as produced by the look-up table in the range and location controller 36 of FIG. 2A and fed to scaler 38' on line 39'. The input audio signal at terminal 30' is also fed to a second scaler 40' that forms a part of the range control block 32'. Scaler 40' is used to scale the amount of signal that is sent through the ranging portion of the embodiment of FIG. 2C. Scaler 40' receives the ranged scale factor value on lines 39' from the look-up table, shown in FIG. 3, as contained within the range and location controller 36 of FIG. 2A. Nevertheless, according to this embodiment of the present invention, it is not necessary to provide a complete set of filters for each input channel. Rather, all that is required is that the location and range processing blocks 32' and 34', similar to 32 and 34, be provided for each input channel such as for terminal 30'. Thus, signal summers or adders 110, 112, 114, and 116, are provided for combining additional input sound signals fed in on lines 118, 120, 122, 124, respectively, to be processed through the left and right front azimuth filters 46, 48, and left and right back azimuth filters 50, 52. Summers may also be placed on the lines feeding into the up and down elevation placement filters 205, 206, and 207, 208 as shown by summers 111, 113 and 115, 117 in FIG. 2A. For example, the outputs 119, 123, 118, 120, 122, 124, 121, 125 from the location control block 34' of FIG. 2C are fed into summers 111, 113, 110, 112, 114, 116, 115, 117 (FIG. 2A), respectively, to be processed through the left and right up elevation filters 205, 206, the left and right front azimuth filters 46, 48, the left and right back azimuth filters 50, 52, and the left and right down elevation filters 207, 208 of FIG. 2B. Range and location control blocks 32 and 34 are then provided for each additional input sound signal. Summers 110, 112 add signals from these other input control blocks that are destined for the left and right sides of the front azimuth placement filters 46 and 48, respectively. Similarly, summers 114 and 116 add signals on lines 122 and 124 from the other input control blocks that are destined for the left and right sides of the back azimuth placement filters 50 and 52, respectively. Further, summers 111 and 113 add signals on lines 119 and 123 from other input control blocks that are destined for the left and right sides of the up elevation placement filters 205 and 206, respectively. Summers 115 and 117 add signals on lines 121 and 125 from other input control blocks that are destined for the left and right sides of the down elevation placement filters 207 and 208, respectively.

In keeping with this approach, summers 126, 128, 130, 132 combine additional input sound signals for processing through the front early reflection filters 88, 90, the back early reflection filters 92, 94 and the reverberation filters 96, 98. More specifically, summers 126 and 128 add signals on lines 134 and 136, respectively, from other range and location control blocks that are destined for the left and right sides of the front early reflection filters 88, 90, respectively. Summers 130 and 132 add signals on lines 180 and 182, respectively, from other input control blocks that are destined for the left and right sides of the back early reflection filters 92, 94, respectively. For example, summers 126 and 128 of FIG. 2A add signals from lines 134 and 136 respectively of the second range control block 32' of FIG. 2C. The summed signals are destined for the left and right sides of the front early reflection filters 88, 90 respectively of FIG. 2B. Summers 130 and 132 add signals 180 and 182 respectively from the second location control block that are destined for the left and right sides of the back early reflection filters 92, 94 (FIG. 2B) respectively.

The signal for the left front early reflection filter 88 is added to the signal for the left back early reflection filter 92 in summer 138 and is fed to the left reverberation filter 96. The signal for the right front early reflection filter 90 is added to the signal for the right back early reflection filter 94 in summer 140 and fed to the right reverberation filter 98. The left and right reverberation filters 96 and 98 produce the reverberant or third portion of the simulated sound as described above.

The front early reflection filters 88, 90 and the back early reflection filters 92, 94 according to this embodiment can be made up of sparsely spaced spikes that represent the early sound reflections in a typical real room. It is not a difficult problem to arrive at a modeling algorithm using the room dimensions, the position of the sound source, and the position of the listener in order to calculate a relatively accurate model of the reflection path for the first few sound reflections. In order to provide reasonable accuracy, calculations in the modeling algorithm take into account the angle of incidence of each reflection, and this angle is incorporated into the amplitude and spacing of the spikes in the FIR. The values derived from this modeling algorithm are saved as a finite impulse response filter with sparse spacing of the spikes and, by passing part of the sound signals through this filter, the early reflection component of a typical room response can be created for the given input signal.

FIG. 5 represents the spikes present in such an early reflection filter as might be derived in a typical real room and, in this case, the spikes represent the six reflections of various respective amplitudes as time progresses from the start of the sound signal. FIG. 5 shows six such early reflection sound spikes. FIG. 5 is an example of an early reflection filter based on the early reflection modeling algorithm and shows six reflections as matched pairs between the left and right sides of the room filter, for example, the first reflection is shown at 150, the second reflection at 152, the third reflection at 154, the fourth reflection at 156, the fifth reflection at 158, and the sixth reflection at 160. These spikes, of course, are represented as the amplitude of the early reflection sound signal plotted against time. The use of six early reflections in this example is arbitrary, and a greater or lesser number could be used.

FIG. 6 represents the nature of the pseudo random binary sequence filter that is used to provide the reverberation effects making up the third component of the sound source as taught by the present invention. FIG. 6 shows a portion of the pseudo-random binary sequence filters 96 and 98 used to generate the tail or reverberant portion of the sound processing. As will be noted, the spikes are shown decreasing in amplitude as time increases. This, of course, is the typical exponential reverberant sound in a closed box or the like. The positive or negative direction of each spike is random and there is no inherent significance to the fact that some of the spikes are represented as minus voltage or negative going amplitude.

The outputs from the reverberation filters 96 and 98 are added to the outputs from the early reflection filters to create the left and right signals. Specifically, the output of the left reverberation filter 96 is added to the output of the left back early reflection filter 92 in a summer 142 whose output is then added to the output of the left front early reflection filter 88 in summer 144. Similarly, the output from the right reverberation filter 98 is added to the output of the right back early reflection filter 94 in summer 146 whose output is then added to the output of the right front early reflection filter 90 in summer 148.

The resulting signals from summers 144, 148 are added to the signals from summers 110, 112 at summers 150, 152, respectively to form the inputs to the front azimuth placement filters 46, 48. Thus, all of the sound wave reflections, as represented by the early reflection filters 88, 90, 92, and 94 and the reverberation filters 96, 98 are passed through the azimuth placement filters 46, 48. This results in a more realistic effect for the ranged portion of the processing. As an approach to cutting down on the number of components being utilized, the summers 110 and 150, 144 and 142 could be replaced by a single summer although the embodiment shown in FIGS. 2A and 2B employs four individual components in order to simplify the circuit diagram. Similarly, summers 112, 152, 148, and 146 could be replaced by a single unit. In addition, as a further alternate arrangement, the output from the back early reflection filters 92, 94 could be fed to the input to the back azimuth placement filters 50 and 52, and the output from the reverberation filters 96, 98 could be fed to the inputs of the back azimuth placement filters 50, 52.

The front azimuth placement filter 46, 48 is based on the head related transfer function obtained by measuring the ear inputs for a sound source directly in front of a listener at zero degrees of elevation. This filter can be implemented as a FIR with a length from approximately 0.5 milliseconds up to 5.0 milliseconds dependent upon the degree of realism that is desired to be obtained. In the embodiment shown in FIGS. 2A and 2B the length of the FIR is 3.25 milliseconds. As a further alternative, the front azimuth placement filters 46, 48 can be modeled using an infinite impulse response filter and can be thereby implemented to effect cost savings. Similarly, the back azimuth placement filters 50, 52 are based upon the head related transfer function obtained by measuring the ear input signals for a sound source directly behind a listener at zero degrees of elevation. While this filter is also implemented as an FIR having a length of 3.25 milliseconds, it could also employ the range of lengths described relative to the front azimuth placement filter 46, 48. In addition, the back azimuth placement filters 50, 52 could be implemented as IIR filters. UP elevation placement filters 205, 206 and DOWN elevation placement filters 207, 208 are based on an average of the HRTFs measured for elevated positions of sound sources. A set of changes to the frequency spectrum which when applied to a HRTF will cause it to appear to be elevated. These UP and DOWN elevation placement filters therefore represent the average coloring or biasing measured for elevated sound sources (above or below the listener). While these filters are also implemented as an FIR having a length of 3.25 milliseconds, they could also employ the range of lengths described relative to the front azimuth placement filter 46, 48. The UP and DOWN elevation placement filters are fixed filters. However, if desired, the number of such filters could be changed. In addition, the up elevation placement filters 205, 206 and the down elevation placement filters 207, 208 could be implemented as IIR filters.

In forming the output signals then, the left and right outputs from the front and back azimuth placement filters are respectively added in signal adders 170 and 172 to form the left and right output signals at terminals 174 and 176. Similarly, the left and right outputs from the up and down filters are added together by summers 209 and 210. These summed signals are combined with left and right signals of the front and back filters by summers 170 and 172. Thus, the output signals at terminals 174 and 176 are played back or reproduced using headphones so that the headphone wearer can hear the localization effects created by the circuitry shown in FIGS. 2A, 2B and 2C.

Although the embodiments shown and described relative to FIGS. 2A, 2B and 2C use a combination of location placement filters and two early reflection filters, i.e. a front and back for each filter type, the present invention need not be so restricted and additional placement filters and early reflection filters could be incorporated following the overall teaching of the invention. Appropriate changes to the range and location control blocks would then accommodate the additional placement filters and/or additional early reflection filters.

Furthermore, the amplitude and delay tables can be adjusted to account for changes in the nature of the azimuth placement filters actually used and such adjustment to the look-up tables would maintain the perception of a smoothly varying position for the headphone listener.

Moreover, the range table can also be adjusted to alter the perception of the acoustic space created by the invention. This look-up table may be adjusted to account for the use of a different room model for the early reflections. It is also possible to use more than one set of room models and corresponding range table in implementing the present invention. This would then accommodate the need for different size rooms as well as rooms with different acoustic properties.

Although the present invention and its advantages have been described in detail, it should be understood that various changes, substitutions and alterations can be made herein without departing from the spirit and scope of the invention as defined by the appended claims.

What is claimed is:

1. A method of providing a headphone set with sound signals such that a listener will perceive the sound as coming from a source outside of the listener's head, said method comprising the steps of:

accepting first and second input signals from a signal source;

processing each said first and second input signal so as to produce modified sound signals for presentation to the respective first and second inputs of a headphone set;

said processing step including the steps of:

azimuth adjusting a first portion of said first input signal into at least two output signal portions, one signal portion being delayed and attenuated with respect to the other signal portion;

elevation adjusting a second portion of said first input signal into at least two elevation adjusted signal portions, one signal portion being delayed and attenuated with respect to the other signal portion;

ranging a third portion of said first input signal, said ranging dependent in part on the configuration of a room model, the output of said ranging step being two signals modeled on early reflections based on said room model;

summing said first modeled signal with the undelayed and unattenuated azimuthally adjusted signal and summing said second modeled signal with the delayed and attenuated azimuthally adjusted signal;

passing each said summed signal portion through a Head Related Transfer Function (HRTF);

passing the undelayed and unattenuated elevation adjusted signal portion through a first elevation placement filter forming a first filtered signal and passing the delayed and attenuated elevation adjusted signal portion through a second elevation placement filter forming a second filtered signal;

combining said summed delayed attenuated azimuthally adjusted signal with said second filtered signal to create an input signal for presentation to said second input of said headphone set; and further combining said summed undelayed unattenuated azimuthally adjusted signal with said first filtered signal to create an input signal for presentation to said first input of said headphone set, wherein said listener of said headphone set will perceive said sound as coming from a source located outside the head of the listener in a three dimensional space with the head of the listener as a center of the sphere.

2. The method of claim 1 further comprising the steps of:

azimuth adjusting a first portion of said second input signal into at least two output signal portions, one signal portion being delayed and attenuated with respect to the other signal portion;

elevation adjusting a second portion of said second input signal into at least two elevation adjusted signal portions, one signal portion being delayed and attenuated with respect to the other signal portion;

ranging a third portion of said second input signal, said ranging dependent in part on the configuration of said room model, the output of said ranging step being two signals modeled on early reflections based on said room model;

summing said second modeled signal with the undelayed and unattenuated azimuthally adjusted signal and summing said first modeled signal with the delayed and attenuated azimuthally adjusted signal;

passing each said summed signal portion through a HRTF;

passing the delayed and attenuated elevation adjusted signal portion through a first elevation placement filter forming a first filtered signal and passing the undelayed and unattenuated elevation adjusted signal portion through a second elevation placement filter forming a second filtered signal;

combining said summed delayed attenuated azimuthally adjusted signal with said first filtered signal to create an input signal for presentation to said first input of said headphone set; and further combining said summed undelayed unattenuated azimuthally adjusted signal with said second filtered signal to create an input signal for presentation to said second input of said headphone set.

3. The method of claim 1, wherein said first and second elevation placement filters are implemented using a finite impulse response filter.

4. The method of claim 1, wherein said first and second elevation placement filters are implemented using an infinite impulse response filter.

5. The method of claim 1, wherein said elevation adjusting step comprises the step of:

scaling an amount of signal that is adjusted in the elevation adjusting step.

6. The method of claim 5, further comprising the step of:

determining the respective portions of said undelayed and unattenuated elevation adjusted signal to be passed through a first elevation placement filter and the delayed and attenuated elevation adjusted signal to be passed through a second elevation placement filter.

7. The method of claim 6, further comprising the step of:

receiving a first and second amplitude value and a first and second time delay value from a controller based on a current azimuth parameter value.

8. The method of claim 7, wherein said first time delay value is used to provide a time delay at said first elevation placement filter, and said second time delay value is used to provide a time delay at said second elevation placement filter.

9. The method of claim 8, wherein said first amplitude value is used to determine the portion of said undelayed and unattenuated elevation adjusted signal to be passed through said first elevation placement filter, and said second amplitude value is used to determine the portion of said delayed and attenuated elevation adjusted signal to be passed through said second elevation placement filter.

10. The method of claim 9, further comprising the step of:

receiving a plurality of multiplier factors from said controller.

11. The method of claim 10, wherein at least one of said plurality of multiplier factors is used to further determine the amount of each said summed signal portion and each said elevation adjusted signal to be passed through said first and second elevation placement filters.

12. An apparatus for providing a headphone set with sound signals such that a listener will perceive the sound as coming from a source outside of the listener's head, comprising:

means for accepting first and second input signals from a signal source;

means for processing each said first and second input signal so as to produce modified sound signals for presentation to the respective first and second inputs of a headphone set;

said processing means including:

means for azimuth adjusting a first portion of said first input signal into at least two output signal portions, one signal portion being delayed and attenuated with respect to the other signal portion;

means for elevation adjusting a second portion of said first input signal into at least two elevation adjusted signal portions, one signal portion being delayed and attenuated with respect to the other signal portion;

means for ranging a third portion of said first input signal, said ranging dependent in part on the configuration of a room model, the output of said ranging being two signals modeled on early reflections based on said room model;

means for summing said first modeled signal with the undelayed and unattenuated azimuthally adjusted signal and means for summing said second modeled signal with the delayed and attenuated azimuthally adjusted signal;

means for passing each said summed signal portion through a Head Related Transfer Function (HRTF);

means for passing the undelayed and unattenuated elevation adjusted signal portion through a first elevation placement filter forming a first filtered signal and means for passing the delayed and attenuated elevation adjusted signal portion through a second elevation placement filter forming a second filtered signal;

means for combining said summed delayed attenuated azimuthally adjusted signal with said second filtered signal to create an input signal for presentation to said second input of said headphone set; and means for further combining said summed undelayed unattenuated azimuthally adjusted signal with said first filtered signal to create an input signal for presentation to said first input of said headphone set, wherein said listener of said headphone set will perceive said sound as coming from a source located outside the head of the listener in a three dimensional space with the head of the listener as a center of the sphere.

13. The apparatus of claim 12 further comprising:

means for azimuth adjusting a first portion of said second input signal into at least two output signal portions, one signal portion being delayed and attenuated with respect to the other signal portion;

means for elevation adjusting a second portion of said second input signal into at least two elevation adjusted signal portions, one signal portion being delayed and attenuated with respect to the other signal portion;

means for ranging a third portion of said second input signal, said ranging dependent in part on the configuration of said room model, the output of said ranging being two signals modeled on early reflections based on said room model;

means for summing said second modeled signal with the undelayed and unattenuated azimuthally adjusted signal and means for summing said first modeled signal with the delayed and attenuated azimuthally adjusted signal;

means for passing each said summed signal portion through a HRTF;

means for passing the delayed and attenuated elevation adjusted signal portion through a first elevation placement filter forming a first filtered signal and means for passing the undelayed and unattenuated elevation adjusted signal portion through a second elevation placement filter forming a second filtered signal;

means for combining said summed delayed attenuated azimuthally adjusted signal with said first filtered signal to create an input signal for presentation to said first input of said headphone set; and means for further combining said summed undelayed unattenuated azimuthally adjusted signal with said second filtered signal to create an input signal for presentation to said second input of said headphone set.

14. The apparatus of claim 12, wherein said elevation adjusting means comprises:

means for scaling an amount of signal that is adjusted by the elevation adjusting means.

15. The apparatus of claim 14, further comprising:

means for determining the respective portions of said undelayed and unattenuated elevation adjusted signal to be passed through a first elevation placement filter and the delayed and attenuated elevation adjusted signal to be passed through a second elevation placement filter.

16. The apparatus of claim 15, further comprising:

means for receiving a first and second amplitude value and a first and second time delay value from a controller based on a current azimuth parameter value.

17. The apparatus of claim 16, wherein said first time delay value is used to provide a time delay at said first elevation placement filter, and said second time delay value is used to provide a time delay at said second elevation placement filter.

18. The apparatus of claim 17, wherein said first amplitude value is used to determine the portion of said undelayed and unattenuated elevation adjusted signal to be passed through said first elevation placement filter, and said second amplitude value is used to determine the portion of said delayed and attenuated elevation adjusted signal to be passed through said second elevation placement filter.

19. The apparatus of claim 18, further comprising:

means for receiving a plurality of multiplier factors from said controller.

20. The apparatus of claim 19, wherein at least one of said plurality of multiplier factors is used to further determine the amount of each said summed signal portion a each said elevation adjusted signal to be passed through said first and second elevation placement filters.

* * * * *